US007802324B2

(12) United States Patent
Layfield et al.

(10) Patent No.: US 7,802,324 B2
(45) Date of Patent: Sep. 28, 2010

(54) MODULAR PREFABRICATED SPA

(75) Inventors: Jack Layfield, St. Catharines (CA); Jamie Wright, Port Colborne (CA)

(73) Assignee: 2033875 Ontario Inc., Grimsby, Ontario ( * ) Notice: Subject to any disclaimer, the term of this patent is extended or adjusted under 35 U.S.C. 154(b) by 0 days.

(21) Appl. No.: 10/742,892

(22) Filed: Dec. 23, 2003

(65) Prior Publication Data

US 2005/0132487 A1 Jun. 23, 2005

(51) Int. Cl.
*A47K 3/00* (2006.01)
*A47K 3/10* (2006.01)

(52) U.S. Cl. ..... 4/541.1; 4/584; 4/592

(58) Field of Classification Search ..... 4/506, 4/541.1–541.5, 538, 584, 592; 52/169.7; 220/645

See application file for complete search history.

(56) References Cited

U.S. PATENT DOCUMENTS 4,090,266 A * 5/1978 Price ..... 52/169.7
4,139,115 A * 2/1979 Robinson ..... 220/645
D267,271 S 12/1982 Kingsley et al.
5,345,621 A * 9/1994 Livingston
D436,178 S 1/2001 Larsen et al.
D436,310 S 1/2001 Arnold
D446,309 S 8/2001 Bower
6,349,427 B1 2/2002 Bergstrom
D511,837 S 11/2005 Lloyd
D513,325 S 12/2005 Lloyd
D514,704 S 2/2006 Lloyd
D518,181 S 3/2006 Lloyd

FOREIGN PATENT DOCUMENTS

GB 2040676 A 9/1980

* cited by examiner

*Primary Examiner*—Tuan N Nguyen
(74) *Attorney, Agent, or Firm*—Heenan Blaikie LLP

(57) ABSTRACT

A modular spa comprises a spa shell that includes at least one support member integrally molded therewith, and a support frame supporting the spa shell at the support members. The support frame consists of a number of elongate polymeric support struts that are secured to the support members. The spa shell is typically molded from a composite acrylic/ABS sheet, and has a substantially upright side wall and a rim extending outwardly from the side wall. The rim is integrally molded with and substantially surrounds the support member. The support member is typically a metal or polymeric extrusion, and includes a substantially vertical surface and a flange extending outwardly from the vertical surface. The rim includes a substantially vertical rim face having a lip that surrounds the flange. The spa is enclosed by a cabinet that is secured to the outer surface of the spa shell, below the lip.

26 Claims, 12 Drawing Sheets

MODULAR PREFABRICATED SPA

FIELD OF THE INVENTION

The present invention relates to a recreational spa. In particular, the present invention relates to a modular spa comprising a series of prefabricated spa components.

BACKGROUND OF THE INVENTION

The conventional recreational spa or hot tub comprises a water-carrying shell, a base, and a series of vertically-oriented support members secured to the base and supporting the shell. The shell itself comprises a thermoplastic sheet (such as acrylic, polystyrene and Centrex (trade mark)) molded into the desired shape, and a rigidizing layer (such as fibreglass) applied to the underside of the thermoplastic sheet for reinforcement of the shell. Support members (typically wooden blocks), placed into the rigidizing layer while the rigidizing layer is curing, serve as attachment points for the support members. Water jets, fitted to the shell through holes cut therein, are attached to a water pump via suitable hosing for the circulation of water in the spa. Vertical decorative panels secured to the wooden support members conceal the wooden support members, the water pump and the hosing.

A significant problem with the conventional spa is that their construction is very labour intensive. Since the wooden blocks are secured to the shell via the fibreglass layer, the vertical orientation of each block is a function of the consistency in the thickness of the fibreglass layer. Also, since the wooden blocks are inserted by hand into the fibreglass layer, the horizontal orientation of each block is a function of the consistency in placement of the blocks. As a result, each wooden support member must be hand fit to each respective wooden block and the spa base. Further, since the decorative panels are secured to the wooden support members, the resulting variation in placement of the support members must be taken into account during the fitment of the decorative panels. Accordingly, attempts have been made to prefabricate a number of the spa components to increase consistency in the manufacturing process, and thereby reduce manufacturing and assembly costs.

For instance, Hertzog (U.S. Pat. No. 5,010,603) teaches an above-ground swimming pool formed from a series of modular components. The swimming pool comprises a number of prefabricated planar wall panels that are secured end-to-end to form the periphery of the pool. Wooden brace members are secured to the outer surface of the wall panels, at periodic intervals around the pool, to reinforce the wall panels against buckling and to form the basis of a pool deck. A vinyl liner is suspended within the interior of the pool from a bead retainer secured to the top of the wall panels.

Holland (U.S. Pat. No. 6,637,162) teaches a modular spa system comprising a preformed base, and a number of preformed L-shaped braces, preformed lower wall sections, preformed seat sections, and preformed backrest sections. Typically, the spa components are precast from concrete, or other such material. Each L-shaped brace is secured to the perimeter of the base via mounting holes formed in the base. The lower wall sections are disposed vertically around the centre of the base, and supported by the lowermost portion of the L-shaped braces. The seat sections are disposed around the outer perimeter of the lower wall sections, and are support by the horizontal portion of the L-shaped braces. The backrest sections are disposed around the outer perimeter of the seat sections, and are supported by the upper vertical portion of the L-shaped braces. The base, braces, lower wall sections, seat sections, and backrest sections are all sealed together with caulking.

Although both Hertzog and Holland add some consistency to the manufacturing process, both the vinyl liner and the caulking are prone to leakage. Further, the wooden brace members used by Hertzog must still be hand-fit to the wall panels. Also, the significant number of components required by Hertzog and Holland add to the cost of manufacture. Therefore, the remains a need for a mechanism for manufacturing a modular spa that adds consistency to the manufacturing process, while also reducing manufacturing costs.

SUMMARY OF THE INVENTION

According to a first aspect of the present invention, there is provided a modular spa comprising (1) a spa shell that includes at least one support member integrally molded therewith; and (2) a support frame supporting the spa shell at the at least one support member.

According to a second aspect of the invention, there is provided a spa shell comprising (1) a bottom and a side together defining a fluid support surface; and (2) a support member integrally molded with the side.

In one implementation, the support frame comprises a number of elongate polymeric support struts that are secured to the support members. The spa shell comprises a bottom and a side that together define a fluid support surface. Typically, the spa shell is fabricated from a polymeric sheet, and the bottom is integrally molded with the side.

The support member is integrally molded with the side. In particular, the side comprises a substantially upright side wall and a rim that extends from and surrounds the side wall. The rim is integrally molded with the side wall, and the support member is integrally molded with the rim.

The support member is typically a metal extrusion or a polymeric extrusion, and the rim is molded around a portion of the extrusion. Typically, the rim comprises a composite acrylic layer and an ABS plastic layer, and the support member is disposed within the ABS plastic layer.

The support member has a substantially horizontal top surface, and a substantially vertical outer surface. The rim has a rim top that extends substantially horizontally and outwards from the side wall, and a rim face that extends substantially downwards from the rim top and is distinct from the side wall. The rim top extends over the top surface of the support member, and the rim face extends over the outer surface of the support member. As such, the rim top and the rim face substantially surround the support member, and the support member is integrally molded with the rim top and the rim face.

Preferably, the vertical outer surface of the support member includes a substantially vertical support surface, and a flange that extends outwardly from the support surface. Preferably, the rim face includes a first substantially vertical face that is disposed over the support surface of the support member, and a lip that extend substantially outwards from the first vertical face. The lip is integrally molded with the rim face, and the rim face is integrally molded with the rim top. The lip surrounds the flange, and the flange is integrally molded with the lip.

The support surface of the support member is disposed above the flange, and the first vertical face is disposed above the lip over the support surface. Further, preferably the rim face includes a second substantially vertical face that extends below the lip and is not supported by the support member.

Preferably, the modular spa includes a spa base that comprises a number of interlocked base sections. The support frame is secured to the spa base, and supports the spa shell via the support member. Also, preferably the modular spa includes a cabinet that is secured to the spa shell proximate the support members. Specifically, the cabinet comprises a number of decorative panels that are secured to the spa base and the spa shell. More specifically, each decorative panel is secured at one end (upper) to the second vertical face below the lip, and is also secured at the opposite end (lower) to the spa base.

In one implementation, the support frame is fitted with permanent magnets, and the decorative panels are fitted with metal strips (or vice versa), and the cabinet is secured to the spa shell and the spa base by the magnetic attraction of the metal strips to the permanent magnets.

According to a third aspect of the invention, there is provided a method of assembling a modular spa comprising the steps of (1) providing a prefabricated spa shell, the spa shell comprising a polymeric sheet molded in the shape of a spa and including at least one support member integrally molded the molded polymeric sheet; (2) providing a spa base, and securing a support frame at one end to the at least one support member of the spa shell and at an opposite end to the spa base; and (3) securing a cabinet to the spa shell and to the spa base.

According to a fourth aspect of the invention, there is provided a spa kit comprising (1) a spa shell comprising a polymeric sheet molded in the shape of a spa and including at least one support member integrally molded with the molded polymeric sheet; (2) a support frame for supporting the spa shell at the at least one support member; and (3) a spa base for supporting the support frame.

In one implementation, the spa base comprises a number of interlockable base sections. Optionally, the spa kit also includes a cabinet that is configured for attachment to the spa shell proximate the support members. In particular, the cabinet comprises a number of decorative panels each configured for attachment to the spa base and the spa shell. More particularly, each decorative panel is configured for attachment at one end to the second vertical face below the lip, and for attachment at an opposite end to the spa base. Preferably, the support frame is fitted with permanent magnets, and the decorative panels are fitted with metal strips (or vice versa), and the cabinet is secured to the spa shell and the spa base by the magnetic attraction of the metal strips to the permanent magnets.

According to a fifth aspect of the invention, there is provided a method of fabricating a spa shell comprising the steps of (1) disposing a support member in a spa mold, the spa mold defining a shape of a spa shell; (2) with the mold, molding a polymeric layer around the support member, the polymeric layer adopting the shape of the spa shell, the support member being integrally molded with the polymeric layer; and (3) releasing the polymeric layer and the support member from the mold.

In one implementation, the molding step involves heating the polymeric layer until pliable, and vacuum forming the pliable polymeric layer to the shape of the spa shell and over the support member. The releasing step involves allowing the polymeric layer to cool sufficiently to retain the shape of the spa shell, and then removing the cooled spa shell from the mold.

BRIEF DESCRIPTION OF THE DRAWINGS

The present invention will now be described, by way of example only, with reference to the accompanying drawings, in which:

FIG. 13 is a flowchart depicting the method of assembling the modular spa.

DETAIL DESCRIPTION OF THE PREFERRED EMBODIMENT

Modular Spa 100

Figure 1:
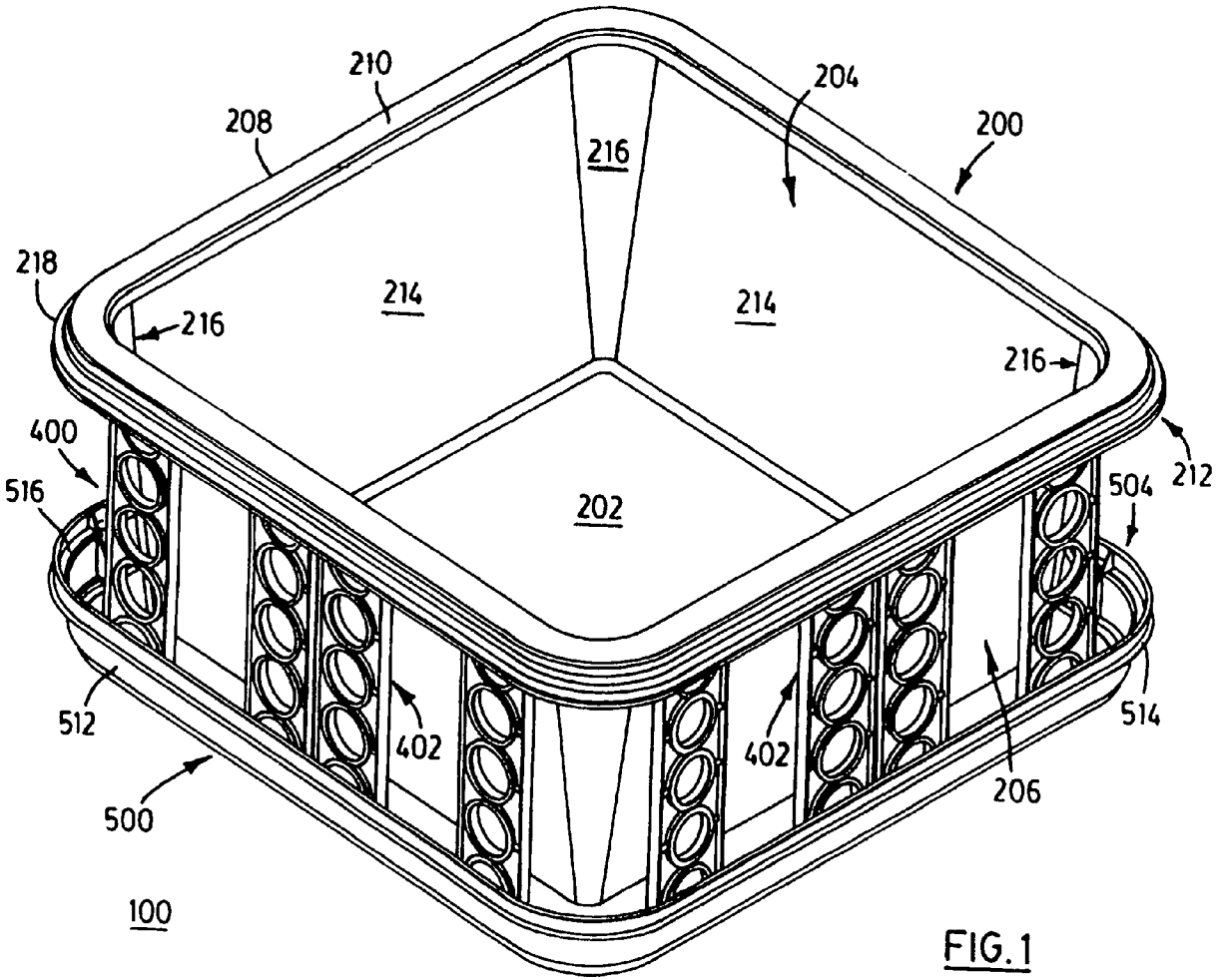
FIG. 1 is a top elevational view of the modular spa, according to the present invention, depicting the spa shell, the support frame, and the spa base.
Figure 2:
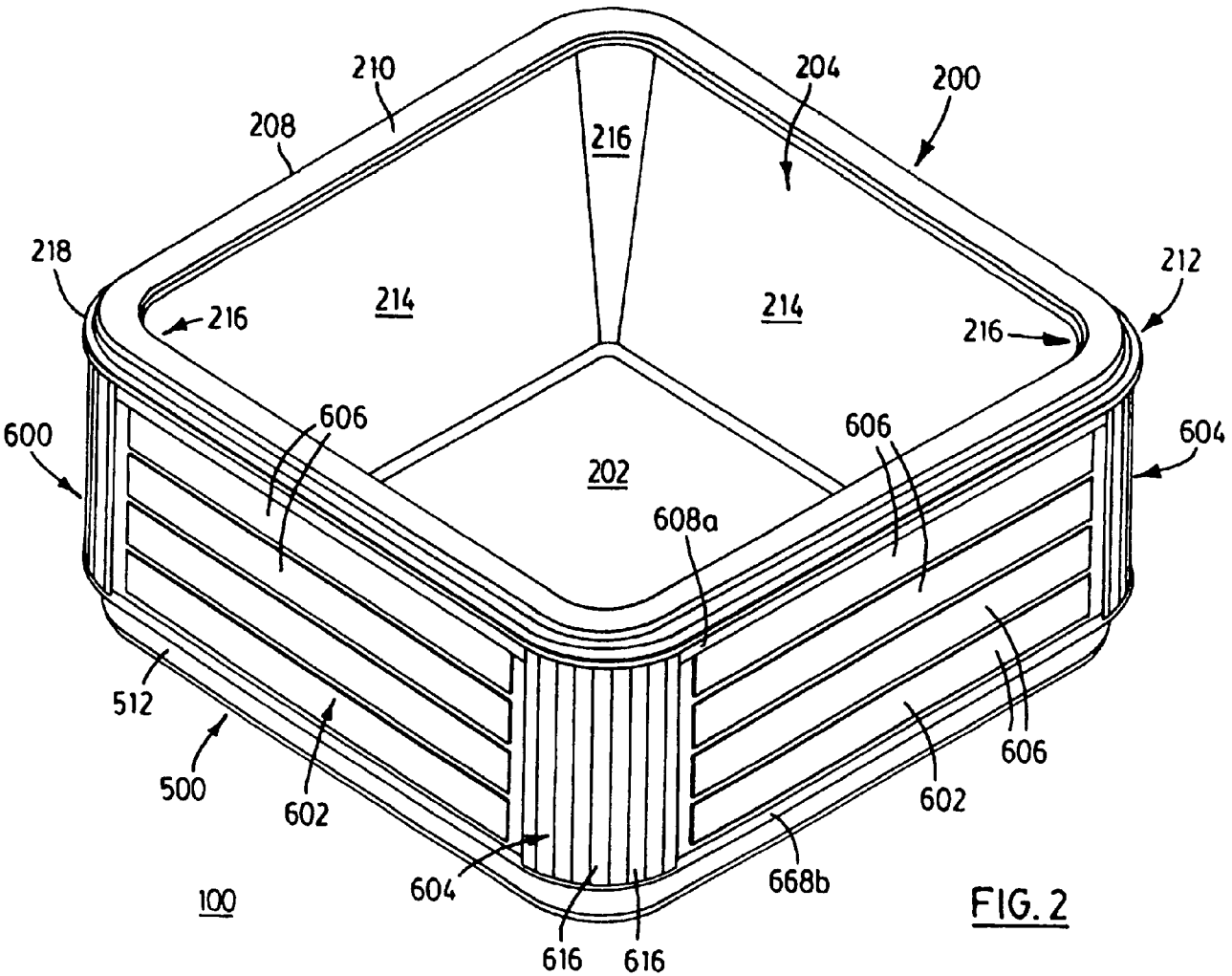
FIG. 2 is another top elevational view of the modular spa, depicting the spa shell, the spa base, and the cabinet.

As shown in FIG. 1, the modular spa, denoted generally as 100, comprises a spa shell 200, and a support frame 400. Preferably, the modular spa 100 also comprises a spa base 500, and a cabinet 600, as shown in FIG. 2. Typically, the modular spa 100 is sold as a kit, with the components of the kit varying with the needs of the purchaser. For instance, one instance of the spa kit might include the spa shell 200, the support frame 400, the spa base 500, and the cabinet 600, whereas another instance of the spa kit might include a subset of these components, such as the spa shell 200 on its own; or the spa shell 200 and the support frame 400; or the spa shell 200, the support frame 400 and the spa base 500. Other variations of the spa kit will be readily apparent.

Spa Shell 200

The spa shell 200 has a bottom 202 and a side 204 that cooperate to define a fluid support surface. The fluid support surface defines an open-top container for retaining therein a fluid, such as water. Typically the spa shell 200 also has a number of seats (not shown) formed in the fluid support surface, upon which occupants of the modular spa 200 can sit.

The spa shell 200 is fabricated from a polymeric material that can be molded into the shape of a spa when heated, and which retains the shape of the spa after being allowed to cool. Preferably, the polymeric material is a composite sheet comprising a hardened thermoplastic water-resistant layer (such as acrylic) disposed on a rigidizing layer (such as ABS plastic or fibreglass), and is vacuum-formed into the desired shape. Alternately, however, the polymeric material may comprise a thermoplastic resin, with or without a rigidizing layer (such as ABS plastic or fibreglass), and is rotationally-molded into the desired shape. Further, preferably the bottom 202 is integrally molded with the side 204, so that the bottom 202 and the side 204 together comprise a unitary water-tight construction.

As shown, the side 204 of the spa shell 200 comprises an upright side wall 206 that extends continuously around the perimeter of the bottom 202, and a continuous rim 208 that extends outwardly from the top of the side wall 206 and surrounds the side wall 206. Preferably, the rim 208 is integrally molded with the top of the side wall 206. The rim 208 includes a rim top 210 that extends substantially horizontally and outwards from the side wall 206, and a rim face 212 that is distinct from the side wall 206 and extends substantially downwards from the rim top 210.

In the embodiment shown, the side wall 206 includes four substantially planar side wall portions 214 and four corner portions 216 disposed between adjacent planar side wall portions 214, thereby giving the spa shell 200 a substantially rectilinear shape. Further, the rim 208 is substantially linear along each side wall portion 214, and is substantially arcuate along each corner portion 216. However, it should be understood that the spa shell 200 is not limited to the shape depicted, but instead can include a lesser or a greater number of side wall portions 214 and corner portions 216. For instance, the spa shell 200 could include six side wall portions 214 and six corner portions 216, thereby giving the spa shell 200 a hexagonal shape. Further, the spa shell 200 need not include only planar wall portions 214, but instead can include arcuate wall portions, thereby giving the spa shell 200 a more arcuate shape.

In addition to the bottom 202 and the side 204, the spa shell 200 also includes a number of prefabricated support members 300 (see FIG. 3) that are integrally molded with the side 204. Specifically, each planar side wall portion 214 includes a respective elongate support member 300 that is integrally molded with the rim 208 of the respective planar side wall portion 214. Each elongate support member 300 is disposed under the rim 208 of the respective planar side wall portion 214, with the rim 208 of each planar side wall portion 214 being molded around the associated support member 300, thereby retaining the elongate support member 300 in place.

Typically, the elongate support members 300 terminate at the corner portions 216, and do not extend into the corner portions 216. Therefore, typically the spa shell 200 is not supported by the elongate support members 300 at the corner portions 216. However, the invention is not so limited. For instance, in one variation, each corner portion 216 includes a respective arcuate support member 300 that is integrally molded with the rim 208 of the respective corner portion 216. Each arcuate support member 300 is disposed under the rim 208 of the respective corner portion 216, with the rim 208 of each corner portion 216 being molded around the associated support member 300, thereby retaining the arcuate support member 300 in place. Alternately, in another variation, the spa shell 200 includes a single continuous support member 300 that is disposed under, and is integrally molded with, the rim 208 of the planar side wall portions 214 and the corner portions 216.

Preferably, each elongate support member 300 comprises an elongate metal or polymeric extrusion, and extends substantially the entire length of the respective planar wall portion 214. Similarly, preferably each arcuate support member 300 comprises an arcuate metal or polymeric extrusion, and extends substantially around the entire corner portion 216. In one implementation, the support members 300 are fabricated from aluminum. However, the support members 300 may be fabricated from other suitable materials, that allow the support members 300 to retain their shape when exposed to the heat that is required to mold the polymeric sheet of the spa shell 200 into the desired spa shell shape.

Each support member 300 is integrally molded with the underside of the rim top 210 and the interior surface of the rim face 212 of the side wall 206. Further, preferably support member 300 is embedded in the rigidizing layer of the polymeric material. Thus, for example, in the implementation where the rigidizing layer is an ABS plastic layer, each support member 300 is embedded in the ABS plastic layer.

Figure 3:
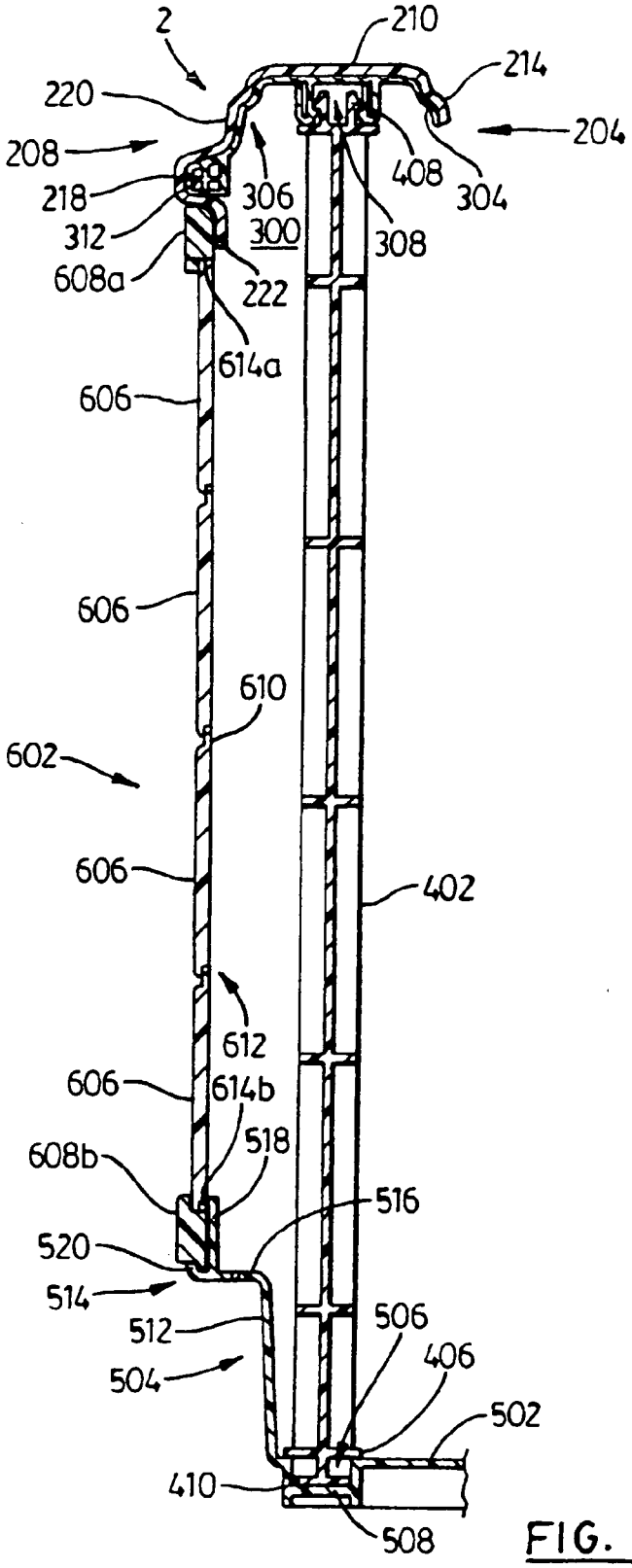
FIG. 3 is a longitudinal cross-sectional view of the modular spa, depicting the rim of the spa shell and the integrally molded support member; one of the support struts of the support frame; and the cabinet side wall sections and the side wall ends of the cabinet.
Figure 4:
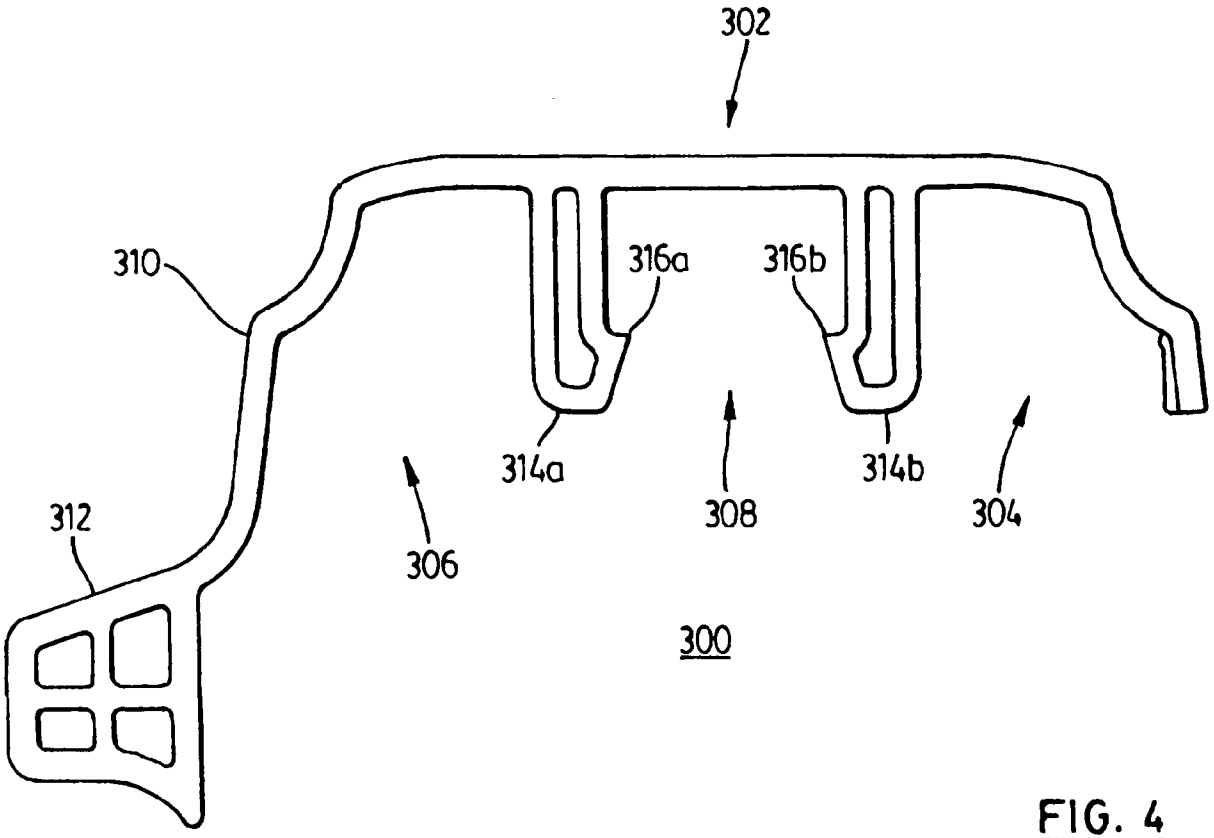
FIG. 4 is a transverse cross-sectional view of the support member depicted in FIG. 3.

As shown in FIGS. 3 and 4, the support member 300 includes a substantially horizontal top surface 302, and an inner surface 304 and an outer surface 306 both extending substantially downwards from opposite sides of the top surface 302. In addition, the elongate support member 300 includes a channel 308 extending downwards from the top surface 302, between the inner surface 304 and the outer surface 306.

The rim top 210 of the rim 208 extends outwards from the respective planar side wall portion 214 over the top surface 302 of the respective support member 300. Each side wall portion 214 is inclined slightly outwards from the bottom 202, and overlays the inner surface 304 proximate the top surface 302. The inner surface 304 is inclined similarly to the side wall portion 214, inwards towards the bottom 202, so that the side wall portion 214 transitions smoothly to the top surface 302 without creating a sharp edge.

The rim face 212 of the rim 208 extends substantially downwards from the associated rim top 210 over the outer surface 306 of the respective support member 300. The outer surface 306 is inclined outwards so that the rim face 212 transitions smoothly from the top surface 302 without creating a sharp edge. As shown, the rim top 210 and the rim face 212 substantially surround the support member 300.

Preferably, the outer surface 306 of the support member 300 includes a substantially vertical support surface 310, and a flange 312 that extends substantially horizontally outwards from the support surface 310. Further, preferably the rim face 212 of the rim 208 includes a substantially channel-shaped lip 218, a first substantially vertical face 220 that is disposed vertically above the lip 218, and a second substantially vertical face 222 that is disposed vertically below the lip 218. The lip 218 is integrally molded with the first vertical face 220 and the second vertical face 222 of the rim face 212, and the rim face 212 is integrally molded with the rim top 210.

The first substantially vertical face 220 is disposed over the support surface 310 of the support member 300. The lip 218 extends substantially outwards from the first vertical face 220 and the second vertical face 222, and surrounds the flange 312 of the support member 300. As such, the support surface 310 of the support member 300 is integrally molded with the first vertical face 220, and the flange 312 of the support member 300 is integrally molded with the lip 218. The second substantially vertical face 222 extends below the flange 312 of the support member 300, and is typically not supported by the support member 300.

As shown, the second substantially vertical face 222 is disposed vertically inwards of the lip 218. As will be explained, the cabinet 600 is secured to the spa shell 200 at the second vertical face 222, below the lip 218. This configuration has the advantage of reducing the likelihood of water dripping from the rim 208 of the spa shell 200 into (or behind) the cabinet 600.

It should be understood that the spa shell 200 may be fabricated without the lip 218. In this variation, the outer surface 306 of the support member 300 does not include the flange 312. The first substantially vertical face 220 extends substantially vertically downwards from the rim top 210. The second substantially vertical face 222 is disposed vertically inwards of the first substantially vertical face 220, and extends substantially vertically downwards from the first substantially vertical face 220 to a location below the support member 300. In this variation, the cabinet 600 is secured to the spa shell 200 at the second vertical face 222, below the first substantially vertical face 220. As above, this configuration has the advantage of reducing the likelihood of water dripping from the rim 208 of the spa shell 200 into (or behind) the cabinet 600.

The channel 308 (of the elongate support member 300) comprises a pair of vertical legs 314*a*, 314*b* that extend vertically downwards from the underside of the top surface 302. Each leg 314 includes a lip 316 that turns inwardly into the channel 308. The legs 314 extend substantially the entire length of the support member 300. As will be explained, the legs 314 are configured to retain the upper end of the support frame 400 within the channel 308, to thereby secure the spa shell 200 to the support frame 400. However, in contrast to the conventional spa shell, since the support members 300 are integrally molded with the spa shell 200, the support members 300 are precisely and accurately located relative to the spa shell 200 and, in particular, relative to the fluid support surface of the spa shell 200. Thus, the support frame 400 will also be precisely and accurately located relative to the spa shell 200.

Support Frame 400

Figure 5:
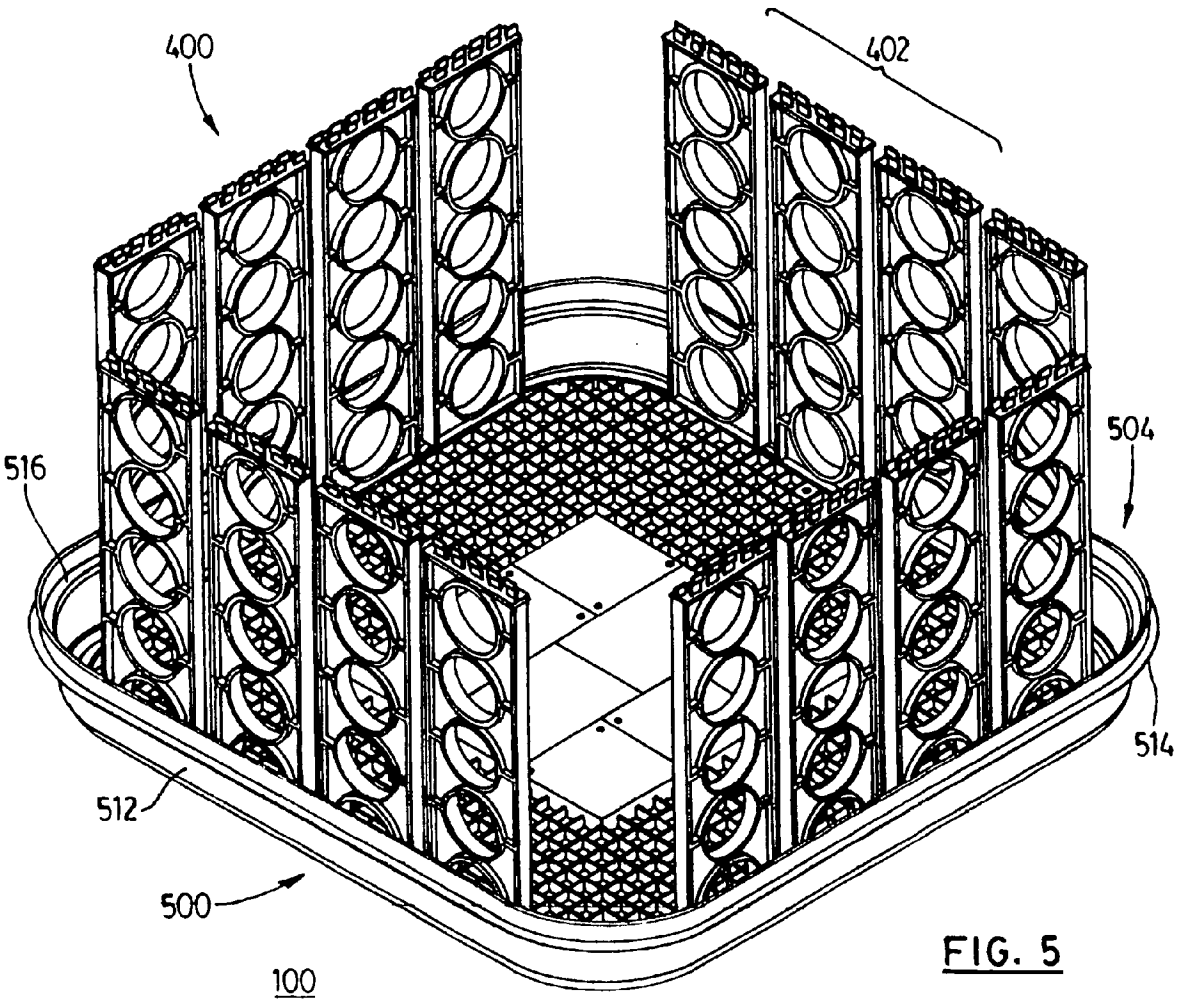
FIG. 5 is another top elevational view of the modular spa, depicting the support frame, and the spa base.
Figure 6D:
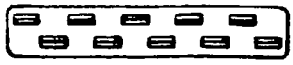
FIG. 6*d* is a top plan view of the support strut.
Figure 6C:
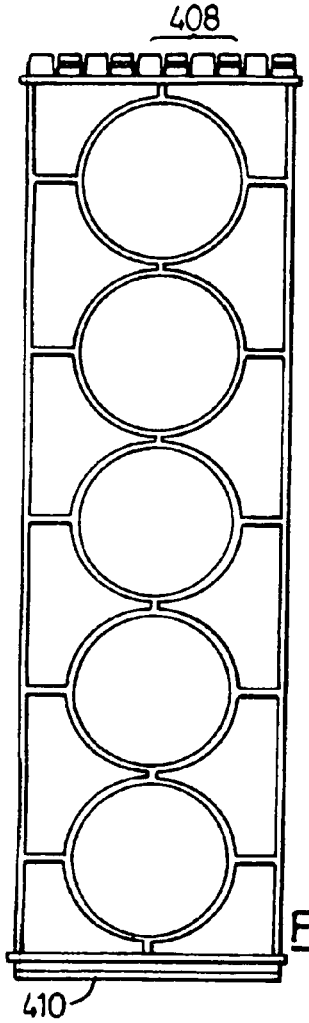
FIG. 6*c* is a front elevation of the support strut.
Figure 6E:
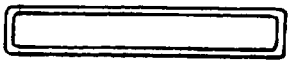
FIG. 6*e* is a bottom plan view of the support strut.
Figure 6B:
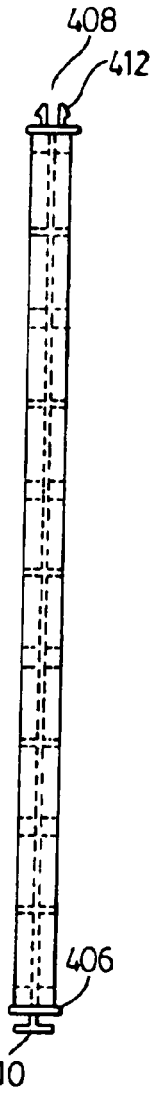
FIG. 6*b* is a side view of the support strut.
Figure 6A:
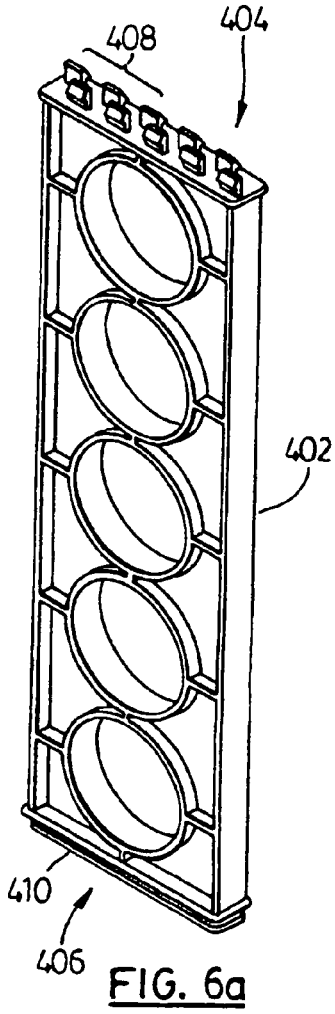
FIG. 6*a* is a perspective view of the support strut shown in FIG. 3.
Figure 7:
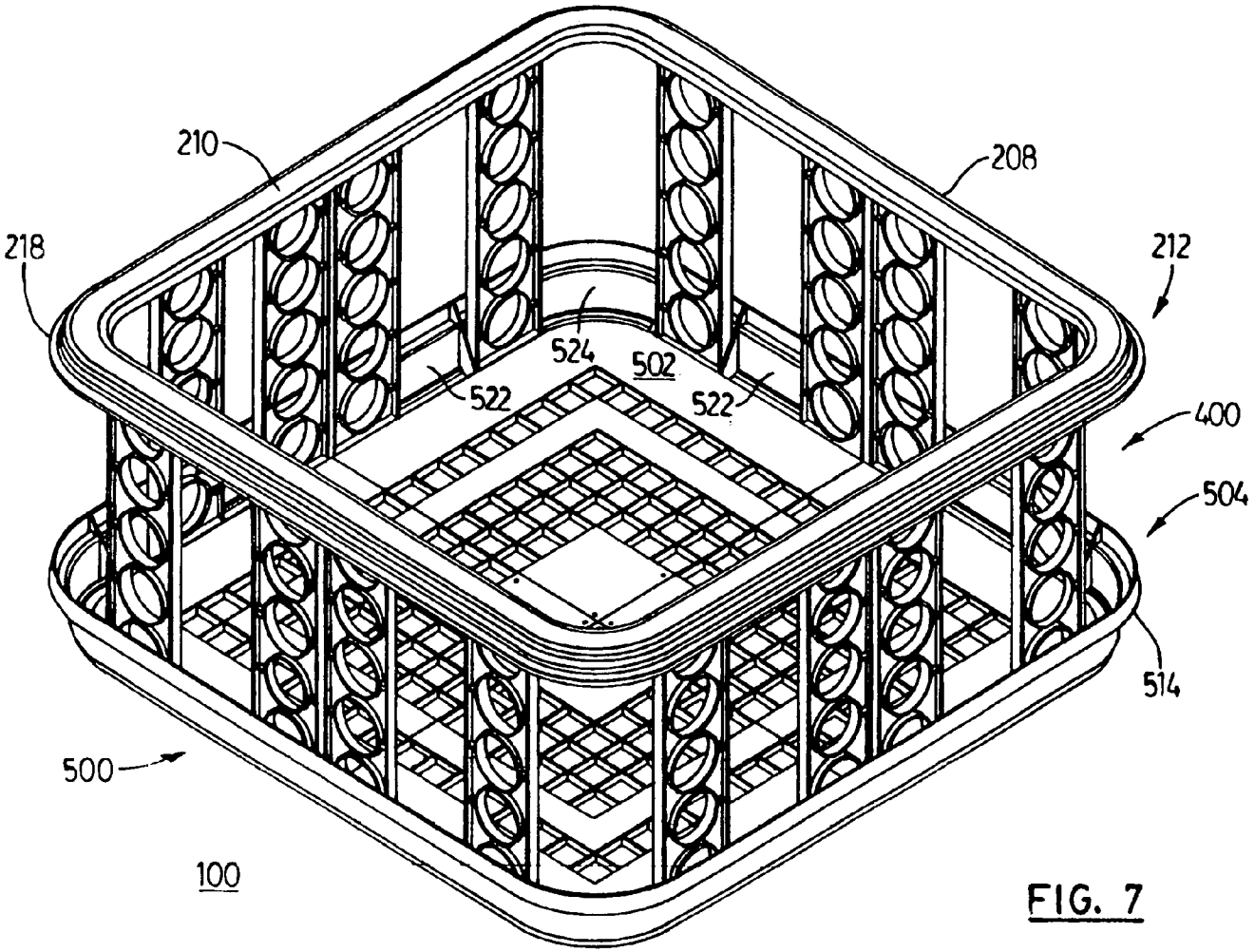
FIG. 7 is another top elevational view of the modular spa, depicting the rim of the spa shell (the upright side wall and the bottom of the spa shell not shown for purposes of clarity), the support frame and the spa base.

As shown in FIG. 1, the support frame 400 extends upwards from the spa base 500, and supports the spa shell 200 at the support members 300. Further, as shown in FIGS. 3 and 5, preferably the support frame 400 comprises a number of prefabricated elongate support struts 402 that are disposed around the perimeter of the spa base 500, and extend substantially upright from the spa base 500. Also, preferably each support strut 402 is injection molded from a plastics material, although the invention is not so limited.

As shown in FIG. 6, each support strut 402 has a substantially planar configuration, and includes an upper end 404 and a lower end 406. Preferably, the upper end 404 and the lower end 406 are parallel to each other. Each support strut 402 also has a number of tabs 408 that extend upright from the upper end 404, and a T-shaped flange 410 that extends downwards from the lower end 406.

Each tab 408 has an inclined flange 412 that cooperates with one of the lips 316 of the channel 308 to define a lock that secures the support strut 402 to the support member 300 of the spa shell 200. As shown, preferably the tabs 408 are staggered along the upper end 404 of the support strut 402.

Figure 9:
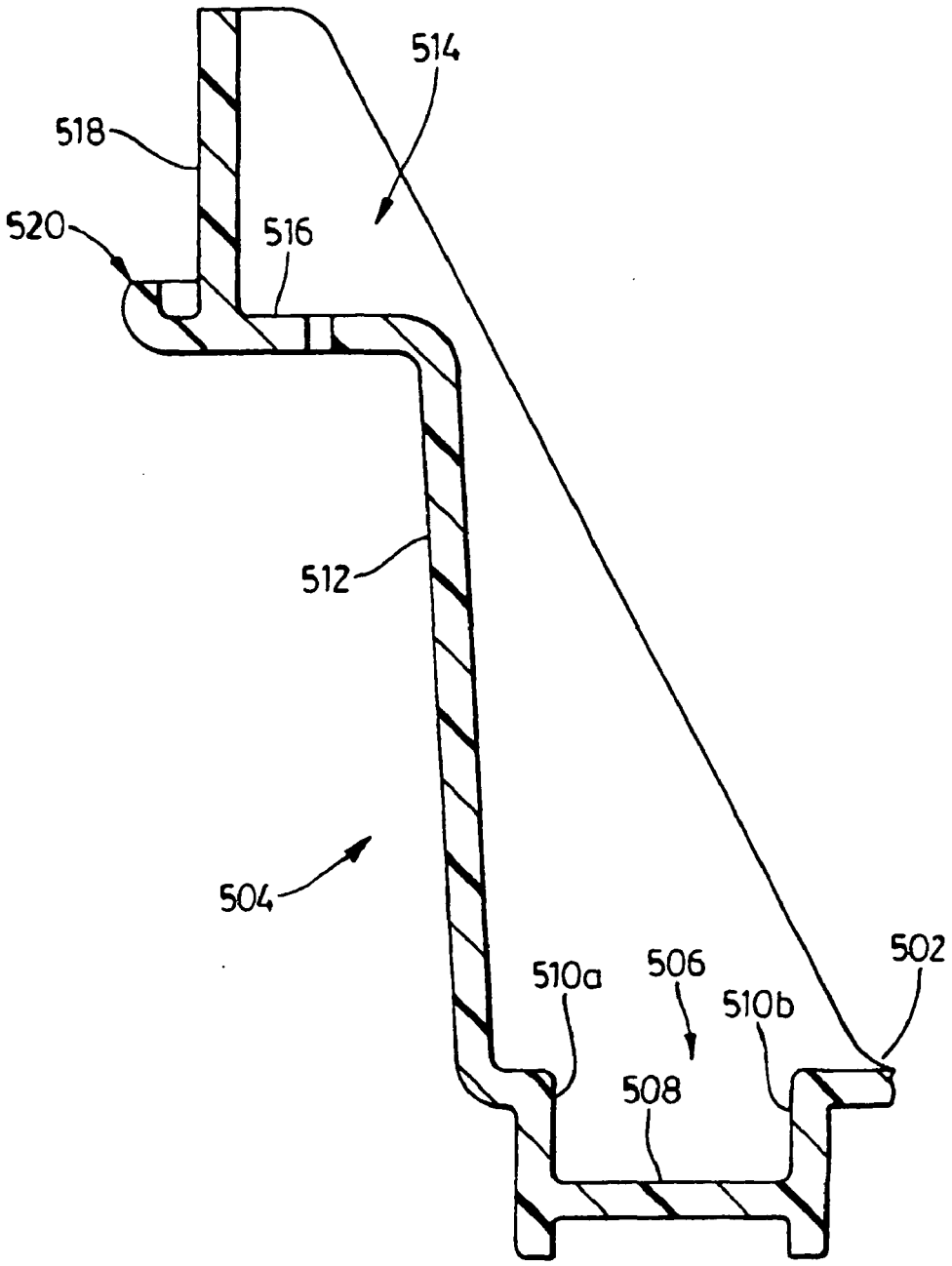
FIG. 9 is a longitudinal cross-sectional view of the bottom and the side of the spa base.

As will be explained, the spa base 500 includes a base channel 506 formed near the periphery of the spa base 500 (see FIGS. 3 and 9). The T-shaped flange 410 of each support strut 402 is configured to be received in the base channel 506. As such, each support strut 402 is secured at the upper end 404 to one of the support members 300, and is secured at the lower end 406 to the spa base 500. Also, the channel 308 of the support member 300 is vertically aligned with the base channel 506, so that the elongate support struts 402 extend substantially vertically between the spa shell 200 and the spa base 500.

Spa Base 500

As shown in FIGS. 7 to 10, the spa base 500 has a bottom 502 and a side 504 that is integrally molded with the bottom 502. The bottom 502 is substantially planar, and includes a base channel 506 that is disposed around the periphery of the bottom 502, and is recessed below the upper horizontal surface of the bottom 502. The base channel 506 comprises a substantially horizontal channel bottom 508, and a pair of upright channel sides 510*a*, 510*b* disposed on opposite sides of the channel bottom 508, and is configured to snugly receive the T-shaped flanges 410 of the support struts 402 therein. As best shown in FIG. 3, preferably the dimensions of the channel bottom 508 and the channel sides 510 are such that the T-shaped flanges 410 can be inserted fully into the base channel 506, with the lower end 406 of the support struts 402 resting against the upper surface of the bottom 502.

The side 504 of the spa base 500 comprises an upright side wall 512 that extends around the perimeter of the bottom 502, outwards of the base channel 506, and a rim 514 that extends outwardly from the top of the side wall 512 and surrounds the side wall 512. Preferably, the rim 514 is integrally molded with the top of the side wall 512. The rim 514 includes a rim top 516 that extends substantially horizontally and outwards from the side wall 512, and a rim face 518 that extends substantially upwards from the rim top 516. The rim face 518 is aligned vertically with the second substantially vertical face 222 of the rim face 212 of the rim 208 of the spa shell 200. Preferably, the rim top 516 extends horizontally past the rim face 518, where the rim face 518 extends upwards from the rim top 516, and terminates in an upturned lip 520.

In the embodiment shown, the spa base 500 has a shape corresponding to that of the spa shell 200 and, in particular, a shape corresponding to that of the rim 208 of the spa shell 200. Accordingly, the side wall 512 includes four substantially planar side wall portions 522 and four corner portions 524 disposed between adjacent planar side wall portions 522, thereby giving the spa base 500 a substantially rectilinear shape. Further, the rim 514 is substantially linear along each side wall portion 522, and is substantially arcuate along each corner portion 524. However, as discussed above, the spa shell 200 is not limited to the shape depicted, but instead can include a lesser or a greater number of side wall portions 214 and corner portions 216. Accordingly, the spa base 500 can also include a lesser or a greater number of side wall portions 522 and corner portions 524. Further, the spa base 500 need not include only planar wall portions 522. Rather, if required to better correspond to the shape of the spa shell 200, the spa base 500 can include arcuate wall portions, thereby giving the spa base 500 a more arcuate shape.

Figure 8:
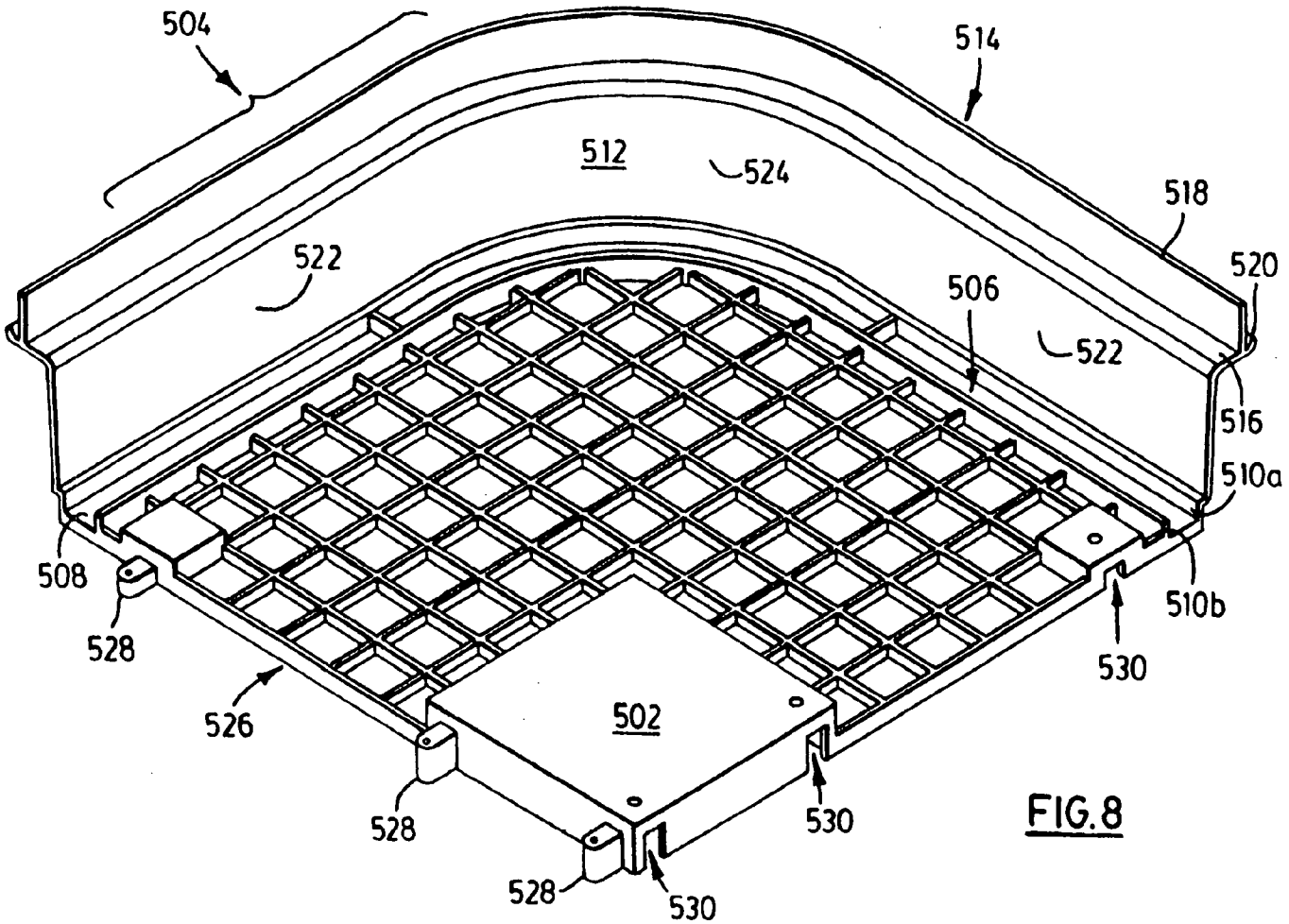
FIG. 8 is a perspective view of one the interlockable base sections of the spa base.
Figure 10:
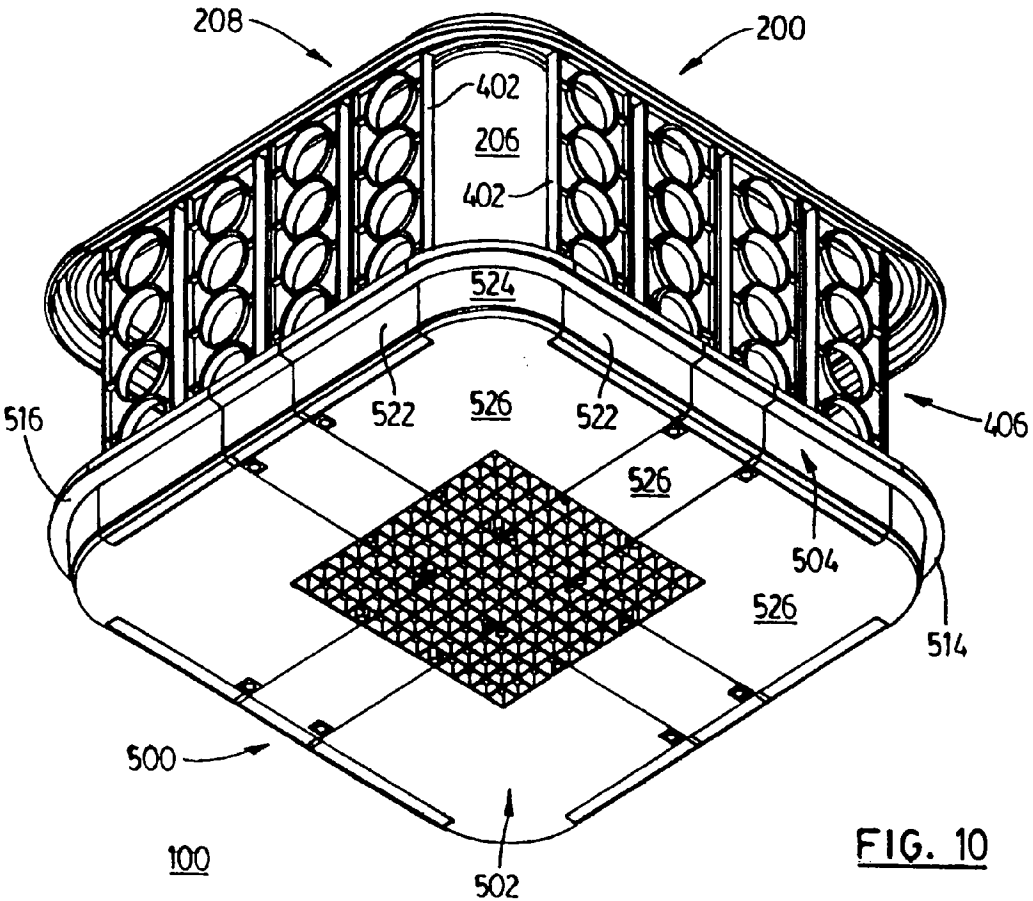
FIG. 10 is a bottom elevational view of the modular spa; depicting the rim and the upright side wall of the spa shell; the support frame; and the interlocked base sections of the spa base.

As shown in FIGS. 8 and 10, preferably the spa base 500 comprises a plurality of prefabricated interlockable base sections 526. Further, preferably each base section 526 is injection molded from a plastics material, although the invention is not so limited. For instance, in one variation, the spa base 500 comprises a unitary construction.

As shown, each base section 526 includes a portion of the spa bottom 502, and a portion of the spa side 504. Also, each base section 526 includes a number of tongues 528 extending outwardly from the edges of the base section 526, and a number of grooves 530 formed into the edges of the base section 526. As will be appreciated, the tongues 528 and grooves 528 of adjacent base sections 526 align with one another, so that the tongues 528 of one base section 526 are snugly received within the grooves 528 of the adjacent base section 526, thereby locking the adjacent base sections 526 together.

As a result, using a relatively small number of base sections 526, the spa manufacturer can fabricate a spa base 500 that can be used with a number of different spa shells 200. Further, as shown, the base sections 526 need not be all the same size, to thereby increase the number of possible variations in the size and shape of the spa bases 500. More importantly, however, since the support frame 400 is precisely and accurately located relative to the spa shell 200, the spa base 500 will also be precisely and accurately located relative to the spa shell 200.

Spa Cabinet 600

As shown in FIG. 2, the cabinet 600 comprises four substantially planar decorative cabinet side walls 602, and four decorative cabinet corners 604 disposed between adjacent planar cabinet side walls 602, thereby giving the modular spa 100 a substantially rectilinear shape. As discussed above, the spa shell 200 and the spa base 500 are not limited to the shape depicted, but instead can include a lesser or a greater number of side wall portions 214, 522 and corner portions 216, 524. Accordingly, the cabinet 600 can also include a lesser or a greater number of cabinet side walls 602 and cabinet corners 604. Further, the cabinet 600 need not include only planar cabinet side walls 602. Rather, if required to better correspond to the shape of the spa shell 200 and the spa base 500, the cabinet 600 can include arcuate wall portions, thereby giving the module spa 100 a more arcuate shape.

Preferably, each decorative cabinet side wall 602 comprises a number of vertically-oriented cabinet side wall sections 606, and a pair of upper and lower side wall ends 608*a*, 608*b*. Similarly, preferably each decorative cabinet corner 604 comprises a number of vertically-oriented cabinet corner sections 616. With this arrangement, the spa manufacturer can manufacture a cabinet 600 for modular spas 100 of a variety of differing shapes and sizes using only a small number of cabinet side wall sections 606, and cabinet corner section 616. Alternately, however, in one variation (not shown), the cabinet side walls 602 and/or the cabinet corners 604 have a unitary construction.

As shown in FIG. 3, the cabinet side wall sections 606 are disposed vertically relative to one another, between the spa shell 200 and the spa base 500. The upper side wall end 608*a* is disposed vertically between the uppermost cabinet side wall section 606 and the lip 218 of the spa shell 200, and the lower side wall end 608*b* is disposed vertically between the lowermost cabinet side wall section 606 and the lip 520 of the spa base 500. The uppermost cabinet side wall section 606 and the upper side wall end 608*a* are both disposed against the second vertical face 222 of the spa shell 200. Similarly, the lowermost cabinet side wall section 606 and the lower side wall end 608*b* are both disposed against the rim face 518 of the spa base 500.

Each cabinet side wall section 606 is substantially planar, and extends horizontally between the adjoining cabinet corners 604. Further, each cabinet side wall section 606 includes a tongue 610 disposed along its upper edge, and a groove 612 disposed along its lower edge. As will be appreciated, the tongue 610 and groove 612 of vertically-adjacent cabinet side wall sections 606 align with one another, so that the tongue 610 of one cabinet side wall section 606 is snugly received within the groove 612 of the adjacent cabinet side wall section 606, thereby locking the vertically-adjacent cabinet side wall sections 606 together.

The upper and lower side wall ends 608 are substantially planar, and extend horizontally between the adjoining cabinet corners 604. Further, each side wall end 608 includes a groove 614 disposed along one edge thereof. As shown, the groove 614*a* of the upper side wall end 608*a* is disposed at the lower end thereof, and is sized to receive therein the upper edge of the uppermost cabinet side wall section 606. Similarly, the groove 614*b* of the lower side wall end 608*b* is disposed at the upper end thereof, and is sized to receive therein the lower edge of the lowermost cabinet side wall section 606.

The upper side wall end 608*a* is disposed against the second vertical face 222, below the lip 218 of the spa shell 200, thereby concealing the second vertical face 222 at the cabinet side wall 602. Similarly, the lower side wall end 608*b* is disposed against the rim face 518 of the rim 514 of the spa base 500, behind the up-turned lip 520, thereby concealing the rim face 518 at the cabinet side wall 602. Since the rim face 518 is aligned vertically with the second substantially vertical face 222, the cabinet side walls 602 extend substantially vertically between the lip 218 of the spa shell 200 and the rim top 516 of the spa base 500.

The cabinet corner sections 616 are disposed vertically relative to one another, between the spa shell 200 and the spa base 500. The upper corner end 618*a* is disposed between the uppermost corner section 616 and the lip 218 of the spa shell 200, and the lower corner end 618*b* is disposed between the lowermost corner section 616 and the lip 520 of the spa base 500.

Each cabinet corner section 616 is substantially arcuate, and extends vertically between the spa shell 200 and the spa base 500. Further, each cabinet corner section 616 includes a tongue (not shown) disposed along one vertical edge, and a groove (not shown) disposed along the opposite vertical edge. As will be appreciated, the tongue and groove of horizontally-adjacent cabinet corner sections 616 align with one another, so that the tongue of one cabinet corner section 616 is snugly received within the groove of the adjacent cabinet corner section 616, thereby locking the horizontally-adjacent cabinet corner sections 616 together.

The upper end of each cabinet corner section 616 is disposed over the second vertical face 222, below the lip 218 of the spa shell 200, and the lower end of each cabinet corner section 616 is disposed over the rim face 518 of the rim 514 of the spa base 500, behind the up-turned lip 520, thereby concealing the second vertical face 222 and the rim face 518 at the cabinet corners 604.

The upper side wall ends 608*a* and the upper ends of the cabinet corner sections 616 are fastened to the second vertical face 222, thereby securing the upper end of the cabinet side walls 602 and the upper end of the cabinet corners 604 to the spa shell 200. Similarly, the lower ends of the cabinet corner sections 616 are fastened to the rim face 518, thereby securing the lower end of the cabinet corners 604 to the spa base 500. Further, the lower side wall ends 608*b* and the lower ends of the cabinet corner sections 616 are disposed against the rim top 516. As such, the cabinet side walls 602 and the cabinet corners 604 are supported by the spa base 500.

As shown in FIG. 3, the rim face 518 and the up-turned lip 520 define a channel therebetween. The lower side wall end 608*b* includes a tongue that is disposed at the lower end thereof, and extends downwards into this channel. Preferably, this channel is sized to snugly retain the tongue therein, to thereby secure the lower side wall ends 608*b* to the rim face 518. As a result, the lower side wall ends 608*b* are fastened to the rim face 518, thereby securing the lower end of the cabinet side walls 602 to the spa base 500.

Preferably, the side wall ends 608 are secured to the second vertical face 222 using fastening means. Similarly, preferably the cabinet corner sections 616 are secured to the second vertical face 222 and the rim face 518 using fastening means. Suitable fastening means include bolts, screws, staples, or water-resistant adhesive. In this manner, the cabinet 600 is secured to the spa shell 200 and the spa base 500.

Figure 11:
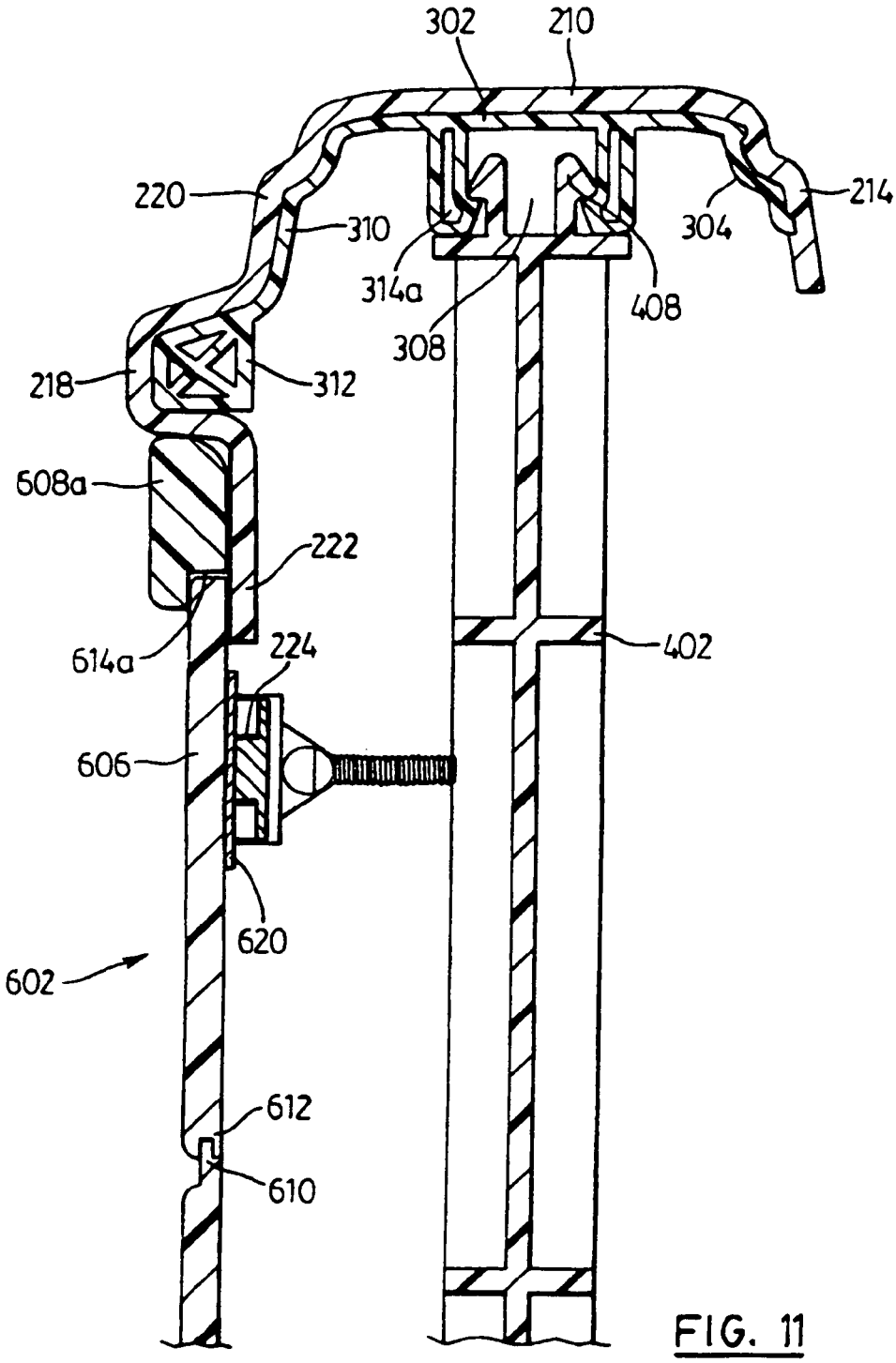
FIG. 11 is a longitudinal cross-sectional view of one variation of the modular spa, in which the cabinet side wall section are secured to the spa shell and the spa base with permanent magnets.

In one variation, the cabinet 600 is secured in place with permanent magnets. As shown in FIG. 11, in this variation, permanent magnets 224 are fastened to the elongate support struts 402, at a position below the second vertical face 222 and the upper side wall ends 608*a*. As shown, the permanent magnets 224 are fastened to the support struts 402 with a threaded fastener. The uppermost ones of the cabinet side wall sections 606 are fitted with metal strips 620. Alternately, in another variation (not shown), the permanent magnets 224 are secured to the second vertical face 222 of the spa shell 200. As will be apparent, the location of the permanent magnets 224 may also be swapped with the metal strips 620, so that the permanent magnets 224 are secured to the cabinet 600.

The metal strips 620 are positioned relative to the permanent magnets 224 such that when the cabinet side walls 602 are brought to bear against the second vertical face 222 of the spa shell 200, the upper end of the cabinet side walls 602 are secured to the spa shell 200 by the magnetic attraction of the upper metal strips 620 to the upper permanent magnets 224. As will be apparent, this attachment mechanism allows the cabinet side walls 602 to be removably secured to the spa shell 200 and the spa base 500, to thereby provide convenient access to the equipment (eg. pump, hoses) located behind the cabinet 600.

Optionally, the spa base 500 may be fabricated without the up-turned lip 520, and additional permanent magnets 224 are fastened to the elongate support struts 402, at a position above the rim face 518 and the lower side wall ends 608*b*. Similarly, the lowermost ones of the cabinet side wall sections 606 are fitted with correspondingly-positioned metal strips 620 to thereby removably secure the lower ends of the cabinet side walls 602 to the spa base 500.

Typically, the cabinet side wall sections 606, the cabinet corners sections 616, and the side wall ends 608 are extruded from a plastics material. However, the invention is not limited to this choice of material or manufacturing process. For instance, the cabinet side wall sections 606, the cabinet corners sections 616, and the side wall ends 608 could be fabricated from wood, if desired. Further, instead of extrusion molding, the cabinet side wall sections 606, the cabinet corners sections 616, and the side wall ends 608 could be roto-molded or vacuum-formed.

Since the spa base 500 is precisely and accurately located relative to the spa shell 200, the cabinet 600 will also be precisely and accurately fitted to the spa shell 200 and the spa base 500 without significant manual effort.

Method of Manufacture

Figure 12:
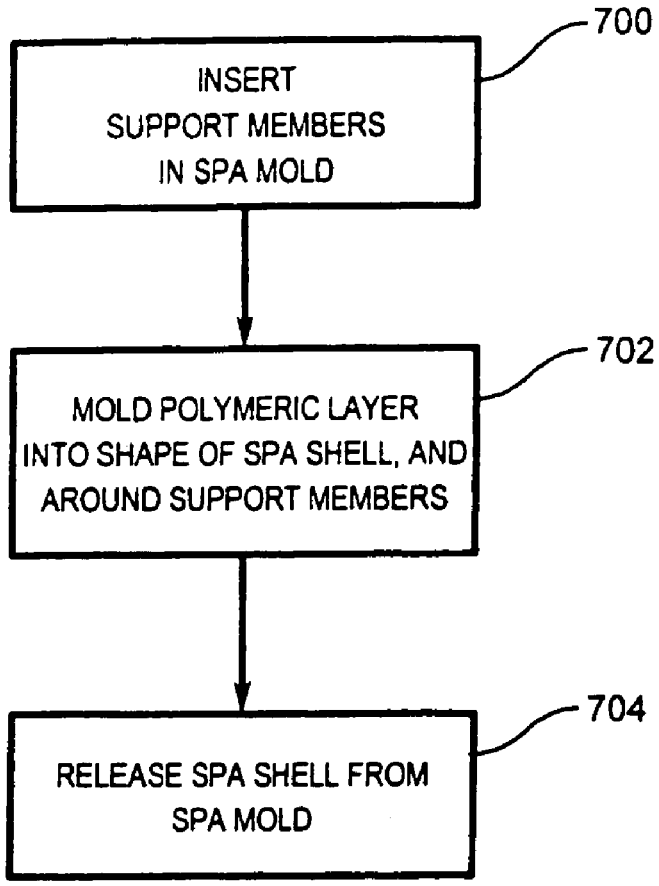
FIG. 12 is a flowchart depicting the method of manufacturing the spa shell.

Having described the modular spa 100 in detail, the method of manufacturing the spa shell 200 will now be described with reference to FIG. 12.

At step 700, support members 300 are disposed into a spa mold. Preferably, the spa mold has a mold cavity that defines the shape of the spa shell 200, and includes a number of small apertures for the application of vacuum to the mold cavity. If the spa shell 200 to be constructed will not include arcuate support members 300 at the corner portions 216, removable arcuate support members 300 are inserted into the mold at the corners.

At step 702, a polymeric sheet is suspended over the mold cavity and clamped in place to the perimeter of the spa mold. As discussed above, the polymeric sheet is typically a composite structure comprising an acrylic layer bonded over a rigidizing layer (such as ABS plastic). The polymeric sheet, support members 300 and the spa mold are then inserted into an oven and heated until the polymeric sheet becomes malleable. A vacuum is applied to the cavity of the spa mold, thereby drawing the polymeric sheet into the mold cavity, and forcing the polymeric sheet to adopt the shape of the spa shell 200. With this step, the polymeric sheet is also molded over and around the support members 300, thereby integrally molding the support members 300 with the polymeric sheet.

Alternately, the spa mold may comprise a rotational mold, and the spa shell 200 is fabricated by injecting a thermoplastic into the mold cavity, and rotating the mold to evenly distribute the thermoplastic resin throughout the mold cavity. As above, the thermoplastic resin adopts the shape of the spa shell 200. However, the support members 300 would not be disposed into the spa mold in advance of the molding process. Instead, the mold cavity would be configured to mold the support members 300 together with spa shell 200 during the rotational molding operation Typically the thermoplastic resin comprises polystyrene, or other material suitable for rotationally molding a spa shell 200.

The molded polymeric sheet (or thermoplastic resin) is allowed to cool sufficiently so that the polymeric sheet (thermoplastic resin) maintains the shape of the spa shell 200. At step 704, the molded polymeric sheet (thermoplastic resin) and support members 300 are removed from the spa mold. If the spa mold included removable arcuate support members 300, the spa mold prevents the molded polymeric sheet (or thermoplastic resin) from becoming molded around these latter support members 300. Accordingly, in this variation, the removable arcuate support members 300 are removed from the spa shell 200 after the polymeric sheet (or thermoplastic resin) has cooled.

Preferably, a rigidizing layer is applied to the underside of the spa shell 200 to impart additional structural rigidity to the spa shell 200. If the spa shell 200 is fabricated by vacuum-forming, the rigidizing layer applied to the spa shell 200 is typically in addition to the rigidizing layer that already forms part of the polymeric sheet. However, if the spa shell 200 is fabricated by rotational-molding, the rigidizing layer applied to the spa shell 200 is typically the only rigidizing layer applied. The additional rigidizing layer is typically not required when rotational molding since rotational molding maintains the thickness of the spa shell 200 with greater consistency than vacuum-forming. Further, rotational molding provides the option of manufacturing the spa shell 200 without the rigidizing layer, depending upon the thickness of the spa shell 200.

A number of the spa shells 200 can be manufactured in this manner. Spa shells 200 having the same shape can be stacked on top of each other. The stacked spa shells 200 can then be packed into a shipping crate, and shipped to a distributor for sale and assembly into modular spas 100. Conventional spas are shipped pre-assembled. As such, most of the volume occupied by the shipping crate is empty space. The approach to manufacture and shipping according to the present invention is advantageous since most of the volume occupied by the shipping crate is taken up by the components of the modular spa 100, thereby reducing shipping costs.

Method of Assembly

The method of assembling the modular spa 100 from the spa shell 200 will now be described with reference to FIG. 13.

At step 800, a prefabricated spa shell 200 is provided that comprises a polymeric sheet (or thermoplastic resin) molded into the shape of a spa. The spa shell 200 includes at least one support member 300 integrally molded the molded polymeric sheet. Holes are cut into the spa shell 200, and water jets are fitted to the spa shell 200 through the holes.

A spa base 500 is provided at step 802. A support frame 400 is then secured at one end to the support members 300 of the spa shell 200, and at the opposite end to the spa base 500. A water pump is then secured to the spa base 500, and flexible hosing is used to coupled the water pump to the water jets. The modular spa 100 is tested for water leakage. If no leaks are detected (or after they are repaired), preferably foam insulation is sprayed or hand-packed into the empty space between the spa base 500 and the underside of the spa shell 200.

The spa cabinet 600 is then secured to the spa shell 200 and to the spa base 500, at step 804, thereby concealing the support frame 400, the water pump, the hosing and the foam insulation. The modular spa 100 can then be shipped to the consumer.

Since the location of the support members 300 are precisely and accurately established by the spa mold, and since the support members are integrally molded with the spa shell 200, the support members 300 are precisely and accurately located relative to the fluid support surface of the spa shell 200. Since the support frame 400 and the spa base 500 comprise prefabricated components, the position of the spa base 500 is also precisely and accurately established relative to the spa shell 200. As a result, the spa cabinet 600 fits precisely and accurately to the spa shell 200 and the spa base 500 without significant manual effort.

The present invention is defined by the claims appended hereto, with the foregoing description illustrating a preferred embodiment of the invention. Persons of ordinary skill may envisage certain modifications to the claimed invention which, although not explicitly described or suggested herein, do not depart from the scope of the invention, as defined by the appended claims.

We claim:

1. A modular spa comprising:

a spa shell including:

(i) a bottom and a side together defining a fluid support surface, the side comprising a substantially upright side wall and a rim extending from and surrounding the side wall; and (ii) a support member integrally molded with the rim, the support member comprising one of a metal extrusion and a polymeric extrusion and including a substantially horizontal top surface and a substantially vertical outer surface, the rim including a rim top extending substantially horizontally and outwards from the side wall over the top surface, and a rim face extending substantially downwards from the rim top and over the outer surface, the rim face being distinct from the side wall, the rim top and the rim face comprising a polymeric sheet substantially surrounding the support member, the vertical outer surface of the support member including a first substantially vertical support surface and a flange extending outwardly from the first support surface, the rim face including a first substantially vertical face disposed over the first support surface and a lip extending substantially outwards from the first vertical face and surrounding the flange; and a support frame supporting the spa shell at the support member.

2. The modular spa according to claim 1, wherein the support frame comprises a plurality of elongate polymeric support struts, and the support struts are secured to the support members.

3. The modular spa according to claim 1, wherein the rim is integrally molded with the side wall.

4. The modular spa according to claim 3, wherein the support member is integrally molded with the rim top and the rim face.

5. The modular spa according to claim 1, wherein the flange is integrally molded with the lip.

6. The modular spa according to claim 5, wherein the lip is integrally molded with the vertical face, and the rim face is integrally molded with the rim top.

7. A spa shell comprising:

a bottom and a side together defining a fluid support surface, the side comprising a substantially upright side wall and a rim extending from and surrounding the side wall; and a support member integrally molded with the rim, the support member including a substantially horizontal top surface and a substantially vertical outer surface, the rim including a rim top extending substantially horizontally and outwards from the side wall aver the top surface, and a rim face extending substantially downwards from the rim top and over the outer surface, the rim top and the rim face substantially surrounding the support member, the vertical outer surface of the support member including a first substantially vertical support surface and a flange extending outwardly from the first support surface, the rim face being distinct from the side wall and including a first substantially vertical face disposed over the first support surface and a lip extending substantially outwards from the first vertical face and surrounding the flange.

8. The spa shell according to claim 7, wherein the rim is integrally molded with the side wall.

9. The spa shell according to claim 7, wherein the support member is integrally molded with the rim top and the rim face.

10. The spa shell according to claim 9, wherein the flange is integrally molded with the lip.

11. The spa shell according to claim 10, wherein the lip is integrally molded with the vertical face, and the rim face is integrally molded with the rim top.

12. The spa shell according to claim 7, wherein the rim face includes at least one of a permanent magnet and a metal strip for removably securing a cabinet to the spa shell.

13. A spa kit comprising:

a spa shell molded in the shape of a spa and including:

(i) a bottom and a side together defining a fluid support surface, the side comprising a substantially upright side wall and a rim extending from and surrounding the side wall; and (ii) a support member integrally molded with the rim, the support member including a substantially horizontal top surface and a substantially vertical outer surface, the rim including a rim top extending substantially horizontally and outwards from the side wall over the top surface, and a rim face extending substantially downwards from the rim top and over the outer surface, the rim top and the rim face substantially surrounding the support member, the vertical outer surface of the support member including a first substantially vertical support surface and a flange extending outwardly from the first support surface, the rim face being distinct from the side wall and including a first substantially vertical face disposed over the first support surface and a lip extending substantially outwards from the first vertical face and surrounding the flange;

a support frame for supporting the spa shell at the support member; and a spa base for supporting the support frame.

14. The spa kit according to claim 13, wherein the support frame comprises a plurality of elongate polymeric support struts, and the support struts are configured to be secured to the support members.

15. The spa kit according to claim 13, wherein the rim is integrally molded with the side wall.

16. The spa kit according to claim 13, wherein the support member is integrally molded with the rim top and the rim face.

17. The spa kit according to claim 13, wherein the flange is integrally molded with the lip.

18. The spa kit according to claim 17, wherein the lip is integrally molded with the vertical face, and the rim face is integrally molded with the rim top.

19. The spa kit according to claim 17, further including a cabinet for attachment to the spa shell proximate the support members.

20. The spa kit according to claim 19, wherein the cabinet comprises a plurality of decorative panels, each said decorative panel being configured for attachment to the spa base and the spa shell.

21. The spa kit according to claim 20, wherein the spa base comprises a plurality of interlockable base sections.

22. The spa kit according to claim 19, wherein the cabinet is configured for attachment at one end to the second vertical face below the lip, and for attachment at an opposite end to the spa base.

23. The spa kit according to claim 19, wherein one of the support frame and the spa shell includes a first permanent magnet for removably securing the cabinet thereto.

24. The spa kit according to claim 23, wherein the spa base includes at least one of a second permanent magnet for removably securing the cabinet to the spa base.

25. The spa kit according to claim 13, wherein the polymeric sheet includes an acrylic layer, and an ABS plastic layer bonded to the acrylic layer.

26. The spa kit according to claim 25, wherein the bottom is integrally molded with the side.

* * * * *